US007416140B2

(12) United States Patent
Camilleri et al.

(10) Patent No.: US 7,416,140 B2
(45) Date of Patent: Aug. 26, 2008

(54) DISPOSABLE CUP TO BE SET UP ON A SPRAY GUN FOR PREPARING, APPLYING AND PRESERVING A PAINT

(76) Inventors: Michel Camilleri, 6 route de Bischwiller, 67460 Souffelweyersheim (FR); Joseph Guarino, Route de Malemort, 84380 Mazan (FR)

( * ) Notice: Subject to any disclaimer, the term of this patent is extended or adjusted under 35 U.S.C. 154(b) by 479 days.

(21) Appl. No.: 10/540,777

(22) PCT Filed: Aug. 26, 2004

(86) PCT No.: PCT/IB2004/003552

§ 371 (c)(1),
(2), (4) Date: Jun. 27, 2005

(87) PCT Pub. No.: WO2005/018815

PCT Pub. Date: Mar. 3, 2005

(65) Prior Publication Data

US 2006/0113409 A1 Jun. 1, 2006

(30) Foreign Application Priority Data

Aug. 26, 2003 (FR) ..... 03 10177

(51) Int. Cl.

| | |
|---|---|
| ***B05B 9/04*** | (2006.01) |
| ***B05B 9/047*** | (2006.01) |
| ***B05B 11/02*** | (2006.01) |
| *B05B 9/00* | (2006.01) |

(52) U.S. Cl. ..... 239/321; 239/320; 239/379; 239/302; 239/316; 222/105; 222/183

(58) Field of Classification Search ..... 239/526, 239/71, 293, 415, 528, 290, 527, 74, DIG. 14, 239/340, 345, 318, 302, 321, 320, 316, 379; 73/714, 753, 756; 222/105, 183
See application file for complete search history.

(56) References Cited

U.S. PATENT DOCUMENTS

| | | | | | |
|---|---|---|---|---|---|
| 3,240,398 | A | * | 3/1966 | Dalton, Jr. | 222/630 |
| 4,832,232 | A | * | 5/1989 | Broccoli | 222/188 |
| 5,042,840 | A | * | 8/1991 | Rieple et al. | 280/830 |
| 5,582,350 | A | * | 12/1996 | Kosmyna et al. | 239/345 |
| 5,655,714 | A | * | 8/1997 | Kieffer et al. | 239/318 |

(Continued)

FOREIGN PATENT DOCUMENTS

| | | |
|---|---|---|
| EP | 0 987 060 | 3/2000 |

(Continued)

*Primary Examiner*—Len Tran
*Assistant Examiner*—James S Hogan
(74) *Attorney, Agent, or Firm*—Davis Bujold & Daniels, P.L.L.C.

(57) ABSTRACT

Disposable cup for preparing, applying and preserving a paint to be set up on a paint spray gun characterized in that it includes on one of its end faces a closable vent device (7) forming a vent valve with valve duct (22) and valve plug (25) which allows when opened, to let the air pass for occupying the inner volume that empties and when closed, to close liquid-tightly the opening (6) of air passage to form a container for the preparation of the paint and then to form a pot for the preservation of the leftover paint. This invention is of interest to manufacturers of paint spray guns.

21 Claims, 6 Drawing Sheets

U.S. PATENT DOCUMENTS

| | | | | |
|---|---|---|---|---|
| 5,816,501 | A * | 10/1998 | LoPresti et al. | 239/302 |
| 6,435,426 | B1 * | 8/2002 | Copp, Jr. | 239/346 |
| 6,675,845 | B2 * | 1/2004 | Volpenheim et al. | 141/380 |
| 6,874,656 | B2 * | 4/2005 | Rohr et al. | 222/1 |
| 6,945,429 | B2 * | 9/2005 | Gosis et al. | 222/105 |
| 6,962,432 | B2 * | 11/2005 | Hofeldt | 366/118 |
| 2002/0134861 | A1 | 9/2002 | Petrie et al. | |
| 2003/0121476 | A1 | 7/2003 | McIntyre et al. | |

FOREIGN PATENT DOCUMENTS

| | | | |
|---|---|---|---|
| EP | 987060 | A1 * | 3/2000 |
| WO | WO 03/045575 | | 6/2003 |

* cited by examiner

DISPOSABLE CUP TO BE SET UP ON A SPRAY GUN FOR PREPARING, APPLYING AND PRESERVING A PAINT

This application is a national stage completion of PCT/IB2004/1003552 filed Aug. 26, 2004 which claims priority from French Application Ser. No. 03/10177 filed Aug. 26, 2003.

FIELD OF THE INVENTION

This invention refers to a disposable cup to be set up on a paint spray gun for preparing and applying paint, and preserving the unused or leftover paint.

BACKGROUND OF THE INVENTION

It is known that spray gun painters have to face difficult operations in preparing the paints, and transferring them from one container into another, which introduces the risk of spillage and paint loss. It is also known that due to increasing costs of labour, all employers try to find solutions allowing for an increase in rapidity for the interventions.

In this spirit, different solutions have been developed for disposable cups or flexible disposable bags containing the paint during the preparation and spraying work.

These solutions reduce the time involved in cleaning equipment and reduce the use of cleaning products based on solvents, which are often non environmentally friendly.

It remained to solve the problem of paint leftovers. These paint leftovers are not to be kept for a long period of time, but used for future work, for example on the same object.

It remained also to find a solution for the paint losses spilling out of the vent due to sudden movements or twists or acute tilting generated by the painter.

SUMMARY OF THE INVENTION

The general object of this invention is to remedy these drawbacks and provide additional advantages based on its own characteristics.

For this purpose, this invention refers to a disposable cup for the preparation of a paint and its application with a spray gun. This cup being set on a gun in particular a gravity gun, and having a body, e.g. in the general shape of a truncated cone pot with a bottom including an air outlet and a cover whose outlet conduct is fixed on an adaptator which will be fixed or mounted on the gun, characterized in that the cup includes on one of its walls a closable vent device with a moving part which allows, when opened, to air to enter into the cup to fill the emptying volume and when closed, seals the air outlet in at least a liquid-tight way, in order to make up a container for preparing the paint and to close the outlet duct of the paint by a second moving part, preferably identical to the first one, to provide a container which preserves the paint from air-contact, in order to store the leftover paint.

BRIEF DESCRIPTION OF THE DRAWINGS

Other characteristics and advantages of the invention will appear in the following description, given as an example and accompanied by the drawings where.

DETAILED DESCRIPTION OF THE INVENTION

Figure 1:
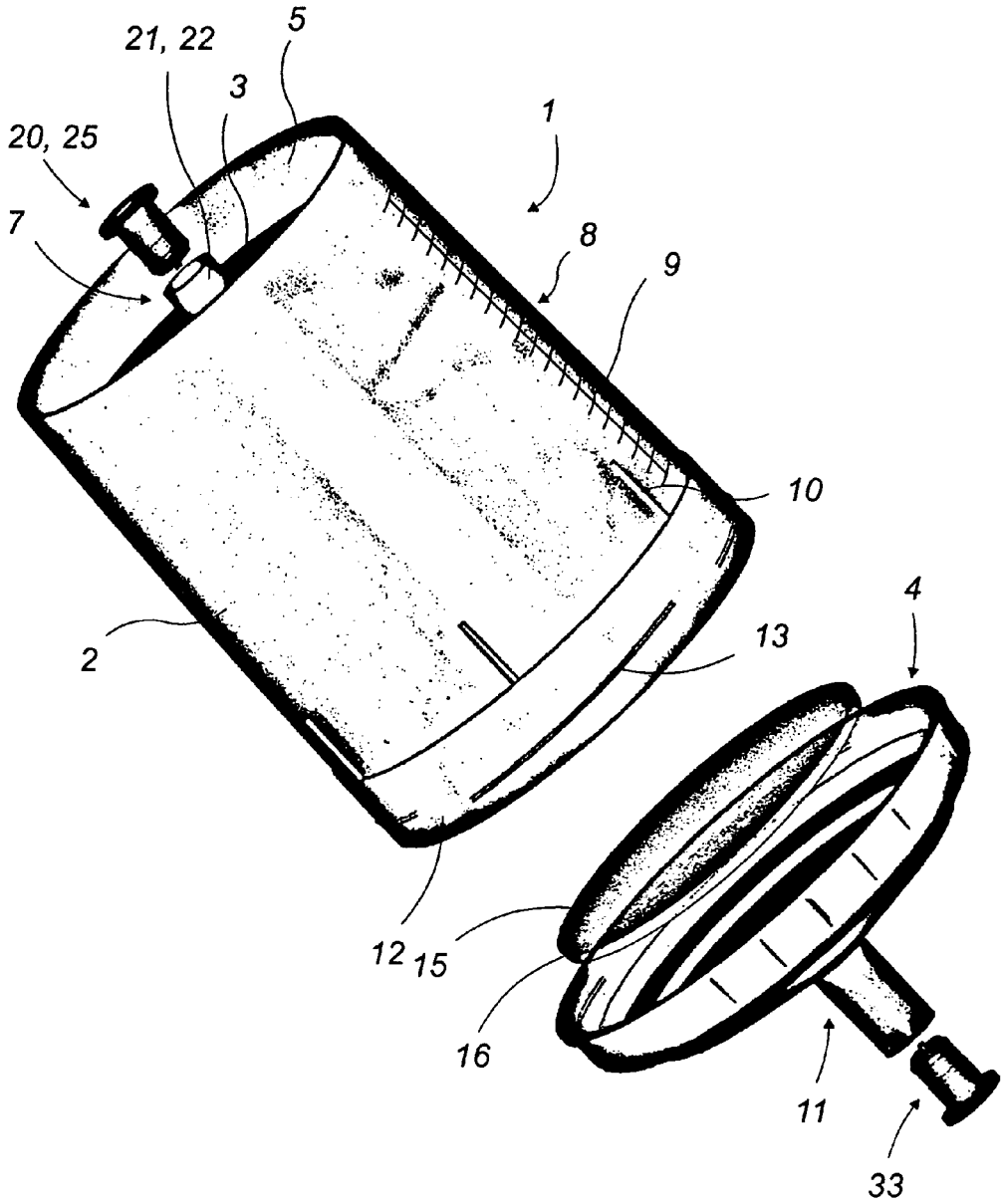
FIG. 1 is a general perspective view of the disposable cup according to the invention.
Figure 2:
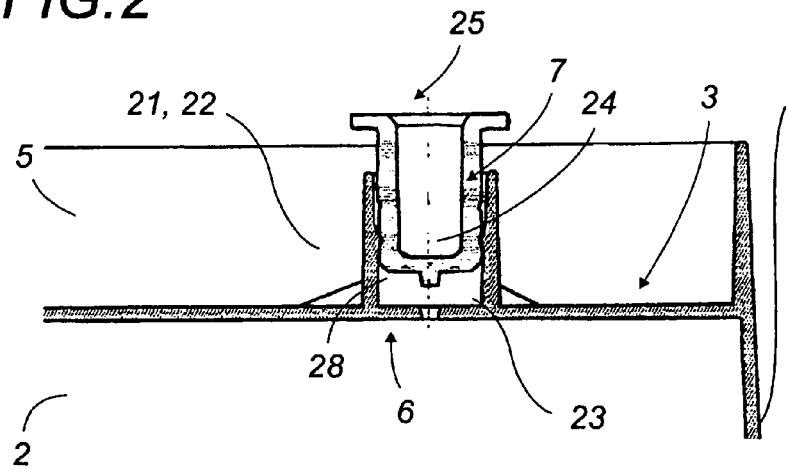
FIG. 2 is a cross sectional view of the lower part through the closable vent device.

The disposable cup for preparing and applying the spray paint is in the form of a container whose body 1 has for example a general cylindrical or truncated cone shape including a side surface 2, a bottom 3 and a cover 4.

The bottom 3 is placed at a certain distance away from the lower edge due to the presence of a lower peripheral annular edge 5 as an extension of the bottom 3. The side surface 2 protrudes in order to provide stability when the cup is standing on a horizontal flat support. The bottom 3 is crossed by an opening 6 forming vent, thus allowing the air intended to replace the used paint in volume to enter and the paint to flow. This air passage vent opening 6 for airflow can either be central or otherwise, as shown in the figures. This vent opening is equipped according to the invention with a closable vent device 7.

The side surface 2 is smooth and has a graduated scale 8 extending along the height of the cup in successive graduations form such as 9, engraved, printed or conformed in the mass. The side surface 2 can be provided with several end reinforcement ribs such as 10 as shown in FIG. 1.

Figure 3:
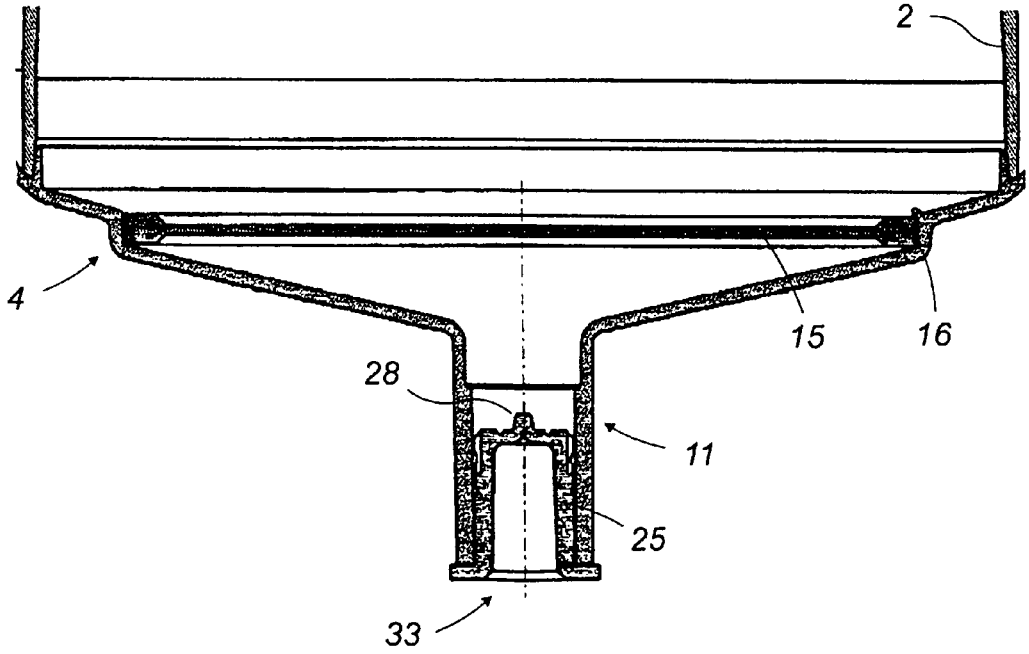
FIG. 3 is a cross sectional view of the cover equipped with a plug.
Figure 8:
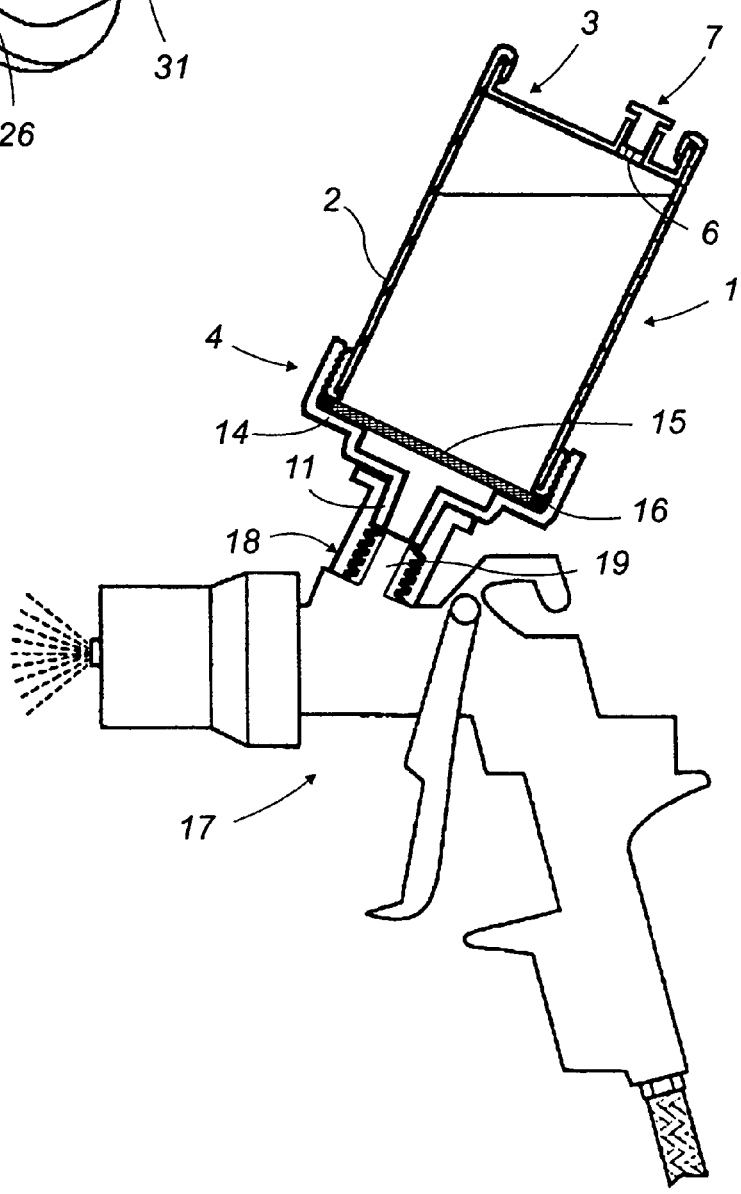
FIG. 8 is a partially sectional view and profile view of the disposable cup according to the invention set up on a gravity gun.

The upper face of body 1 is closed by the funnel-shaped cover 4 having in its central part an outlet duct 11 slightly tapered and cone-shaped. The cover 4 is screwed from its base onto the upper part 12 of the side surface of the body of the cup 1 on which are formed several successive ribs such as 13 forming a thread, for example discontinuous, receiving the corresponding thread conformation of the cover 4 by screwing on the cup body. The cover includes an inward shoulder 14, as shown in FIG. 8, which supports the periphery of a disk-shaped filter 15. The filtering part is surrounded by a perimeter annular joint 16 (FIG. 3).

The cup is set on a paint spray gun, preferably but no exclusively, on a gravity gun 17 by means of an adaptator part 18. This adaptator part 18 can be for example, a hollow piece to be screwed or otherwise assembled or fixed by one of its ends on a protrusion 19 for example a threaded protrusion of the gun and receiving the central conical outlet duct 11 of the cover 4 by tight conical taper fitting. Of course, a lot of other connection means may be appropriated as well as different other existing or future adaptator parts.

This connection by tight conical taper fitting proves to be sufficiently difficult to dissociate and tight enough to be appropriate for the use and the motions of the painter while working.

The closable vent device 7 will be examined now.

The closable vent device 7 fulfils the general valve function by letting the air enter during the paint work, that is to say while the cup empties, and closing the vent opening 6 of the air inlet when the cup is used as a container for preparing the paint.

The closable vent device 7 of the valve type, utilises a movable element 20 and a valve body 21 along which the movable element 20 moves between a closed position and an open position of the vent opening 6.

Preferentially, but not in a limitative way, the movable element 20 is immobilized in the valve body 21 in each of its characteristic positions, namely the closing position and the opening position, and is free between these two positions for its manual operation.

For this purpose, the vent opening 6 for the passage of air through the bottom 3 is surrounded by a hollow cylindrical base 22 reinforced by radial ribs 23 serving as valve body whose height remains lower than that one of the plane defined by the upper ridge of the annular edge 5 in such a way that the cup placed on a horizontal flat surface has a stable position in the corresponding upright second position for preparation of the paint.

This hollow cylindrical base 22 is a duct along which the moving part 20 moves.

Figure 4:
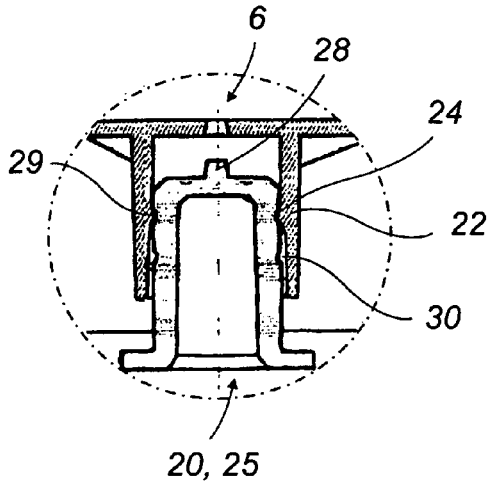
FIGS. 4 and 5 are cross sectional views showing the valve plug in its two characteristic positions respectively open and close.
Figure 5:
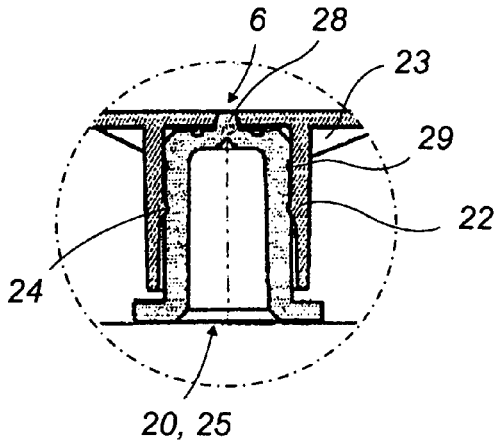
Figure 6:
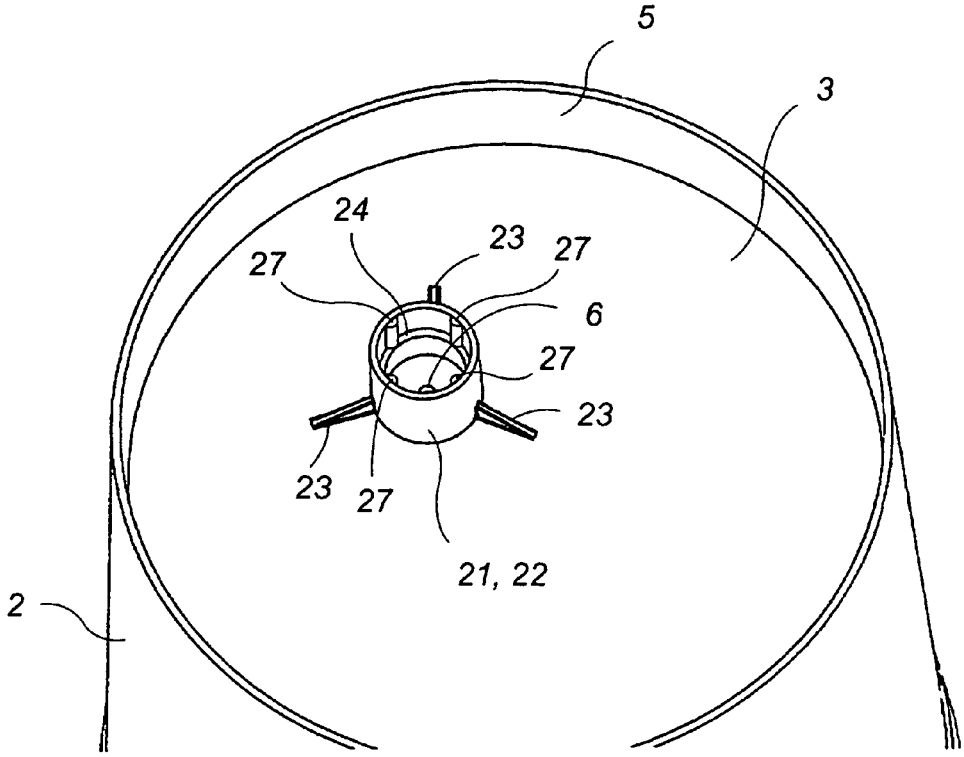
FIG. 6 is a perspective view of the lower part of the cup showing the valve duct protruding from the bottom.

In this base 22 forming a duct, an annular rib 24 is moulded protruding from the inner side surface. The annular rib 24, called a snap-in location rib, provides each time a snap-in location for the movable element 20 to be manually moved inside the valve duct 22. Because of its shape, this part has been called valve plug 25. This valve plug 25 ensures the opening and the closing of the valve in two precise positions. The first one is the closed position in which the end of the plug fills the passage vent opening 6 across the bottom 3 to close it tightly without protruding from the inner face of the bottom 3 and is held in this position by a snap-fit effect. The second position called the open vent position, in which the end of the valve plug 25 is moved away from the passage vent opening 6 of the passage across the bottom 3 of the cup and maintained in this position by a second snap-in protrusion. These positions are those of the valve plug represented in FIGS. 4 and 5.

Of course, the above positions can be effected in other ways: screw stops, notching, quarter turn etc.

Figure 7:
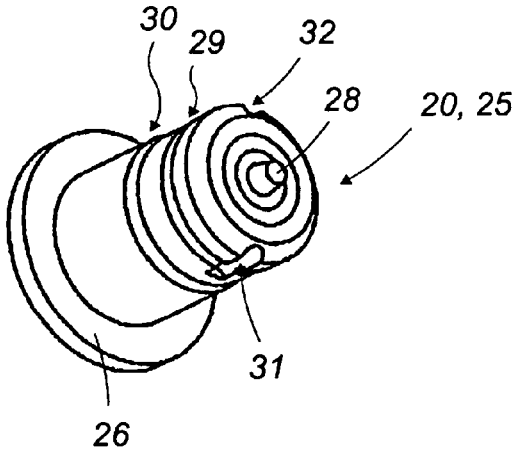
FIG. 7 is a perspective view of the whole body of the valve plug.

For this purpose, the conformation of an example of embodiment of a valve plug 25 is shown in perspective view in FIG. 7.

According to this embodiment, the valve plug 25 is a body, for example hollow, of general cylindrical shape having at one end an upper end disk-shaped with peripheral upper edge 26 having a larger diameter than the body itself in order to form an upper location shoulder and at the other end a lower end frontal face terminated by an end form effecting the closing of the vent opening 6 existing across the bottom 3 without its end protruding out of the inner face of the bottom of the cup and fitting tightly into contact with the section of this vent opening 6 for sealing.

In order to allow the air admission in open position, there is a play or gap between the upper parts of duct 22 and plug 25. This play can be obtained by an increasing of the inner diameter of the upper part of duct 22 or a correlative reduction of the diameter of the upper part of the plug 25 or both simultaneously. In order to hold the plug 25 in central position, three or four centring longitudinal protrusions for example semi-cylindrical shaped ones such 27, of suitable thickness, are provided on the higher part of the inner side surface of duct 22.

Vice versa, these centring protrusions can also be on the side surface of the plug 25.

The plug ends in its lower part with a closing form for example a tapered protrusion 28 of the pin type which has a form and a size suitable for complete liquid-tightness closing the vent opening 6 in pushed position when the vent moving part or plug is in the low closed position.

Of course, this shape can vary on the basis of the form of the opening, provided that the plug in its closed position closes this opening.

Between the two ends of the plug 25, extends a body having a generally cylindrical shape with a side surface having two annular grooves 29 and 30 intended for operating in a snap-in effect with the annular protrusion rib 24 of valve duct 22 in order to locate the latter in one or the other groove of the valve plug 25, as corresponding to one of the abutment positions in open or in closed position.

The forms may, obviously, be changed and especially inverted without modifying the general function, i.e. using protrusions for the side surface of the plug 25 and grooves for the side surface of valve conduct 22.

The plug is made of plastic. The plug is full or hollow, which allows an amount of flexibility.

Furthermore, the closing pin 28 can perforate or tear or press down or break a membrane, a skin or a local weak or weakened point or zone of the bottom face 3, which would close the opening 6 at the manufacturing stage and for the first use. For this purpose, the pin 28 or the end conformation will have a suitable shape for this function, for example a more conical or pointed end or similar or whatever other.

On the side face of the valve plug 25 besides its lower end are formed two longitudinal vent notches 31 and 32 diametrically opposed, extending from the lower end face along the length. The length of these notches is such that they go through the first groove 29 corresponding to the closing stop and extend beyond the latter without reaching the second groove 30. The depth of the vent notches 31 and 32 makes their base be under the base of the first groove 29 in order to form an air passage under the annular protrusion 24 when the valve plug 25 is in its first push position, that is to say in closed position or first protrusion, the annular rib 24 being engaged in the first groove 29.

It is clear that the closing and opening stop positions correspond respectively to the two main uses of the cup according to the invention, i.e. on one hand as a container for preparing the paint and on the other hand a cup for spray gun paint.

All kind of ratchet or clamping or snapping mechanisms are possible for holding the plug in its two positions. Furthermore, the simple inversion of forms in their function or in their position does not change the invention.

In addition, the inner conformation of the outlet duct end 11 of cover 4 can be adapted for receiving a second valve plug 33 as an occasional closing element, creating in this way an additional use of the cup according to the invention, i.e. the protection and preservation of the any leftover paint quantities specially prepared for the work in progress. For this purpose, a particular inner conformation of outlet duct 11 is not necessary. A sufficiently fitted sealing between these two parts ensuring appropriate temporary tightness during the necessary period of conservation is then used.

A plug identical to the first plug 25 is preferably adopted for the second plug 33. Its cost price is low as this is the same piece made in plastic and manufactured by injection moulding.

The preparation of the paint is undertaken in the cup with the vent valve in the closed liquid-tight position or the opening being closed by a membrane or a skin or a reduced wall thickness. For this purpose, the container when placed on a horizontal flat surface is in a stable position due to the protruding annular edge 5 and the painter can easily carry out the preparation with the graduated scale 8 which is on the side surface of the cup body.

In order to proceed with painting, the painter simply needs to close the cup by its cover with its filter, to set up the spray gun on the cover outlet duct eventually with its adaptator part by a simple and fast movement, which is possible due to the tapered conical fitting , to turn the spray gun upside with its cup in place and move the valve plug 25 to the open position i.e. the vent protrusion is received by the snap-in effect in the first groove,. namely the snap-in groove. The painter can thus work easily and without concern for a paint leakage or an untimely paint escaping through the upper side whenever the cup is tilted.

Besides the disposable nature of the cup according to the invention, which provides several advantages, we must add the easy use and gains in time in preparation thanks to its double use and its role as a paint pot for the preservation of the leftover paint ready for future use.

The central protrusion of the valve 22 can be covered by the valve closing movable element 20 as a cap. Thus, a female piece conformed as a cap presenting a central sealing part, which extends downwards according to a general conical form terminated by a sealing conformation, for example a pin in accordance with this fonction, can be appropriate. In the same way, the sealing pin embeds itself tightly in tne vent opening 6 when the cap is in low position without protruding out of the lower face of the base. The charachteristic positions can be marked by cooperation between grooves and annular protrusions, as previously, or other equivalent shapes. The passage of air is realized by longitudinal channels in the cylindrical protruding part or other equivalent means or embodiments.

FIGS. 9 to 13 concern other embodiments of the closable vent device.

Figure 9:
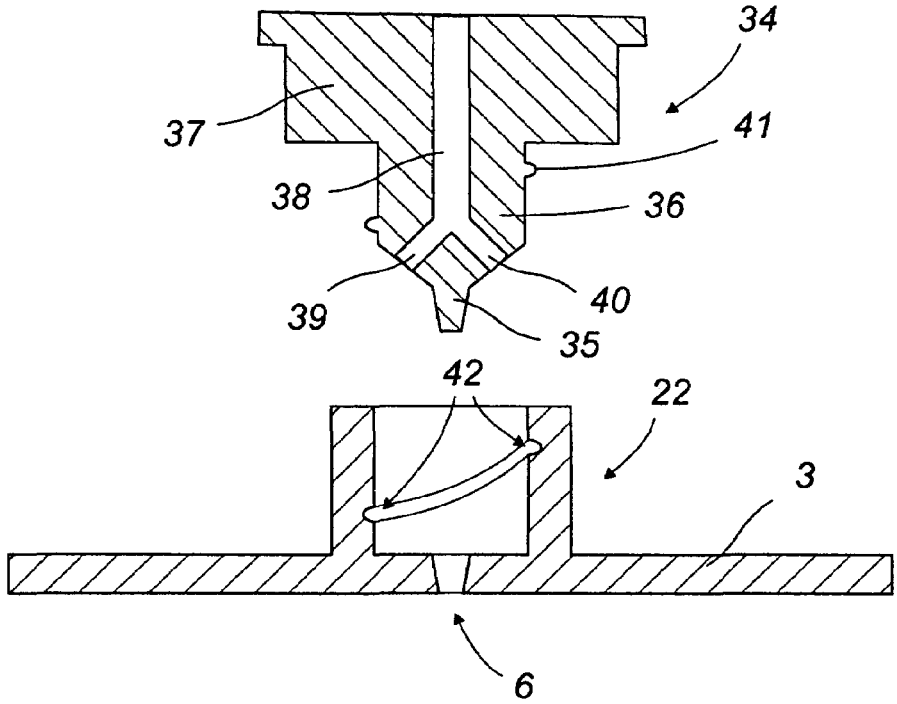
FIGS. 9 and 10 are cross sectional views of two embodiments of the closable vent device in two positions of the moving part.

First of all, FIG. 9 shows an alternative embodiment of plug type 34, for example one to be screwed, whose lower end is terminated by a closing pin 35 for the vent opening 6. The body of the plug 34 has a general T-shaped form with a cylindrical lower part 36 housed in the hollow cylindrical base 22. It continues with a cylindrical head part 37 with a larger diameter eventually surmounted by an even larger part. The body of the plug 34 has a central inner channel 38 for the air to pass and be admitted into the cup, which is divided towards the lower end into two branches 39 and 40. The high position corresponds to the open position of the passage of air at the time of painting while the plug in low position ensures the orifice or the opening of the cup bottom to be closed by the closing pin 35.

The holding in position or location of the plug 34, its guidance downwards towards the closed position and its locking in this position are carried out, for example, by a screw thread. Therefore, male thread 41 is formed in protrusion in the side surface of the cylindrical part 36 of the plug locating with a female thread 42 formed in the inner side surface of the cylindrical protrusion 22. When completely screwed in this corresponds to the closed position in which the plug can be held by snap-in protrusions or by any other means for example with a catch. The same methods apply for the high open position. A fast closing-opening device of the quarter turn type or whatever other may also be used.

According to one of the characteristics of the invention, when the plug is embedded, its upper end does not protrude out of the surface defined by the outer upper ridge of the edge 5 in protrusion of the cup bottom.

Figure 10:
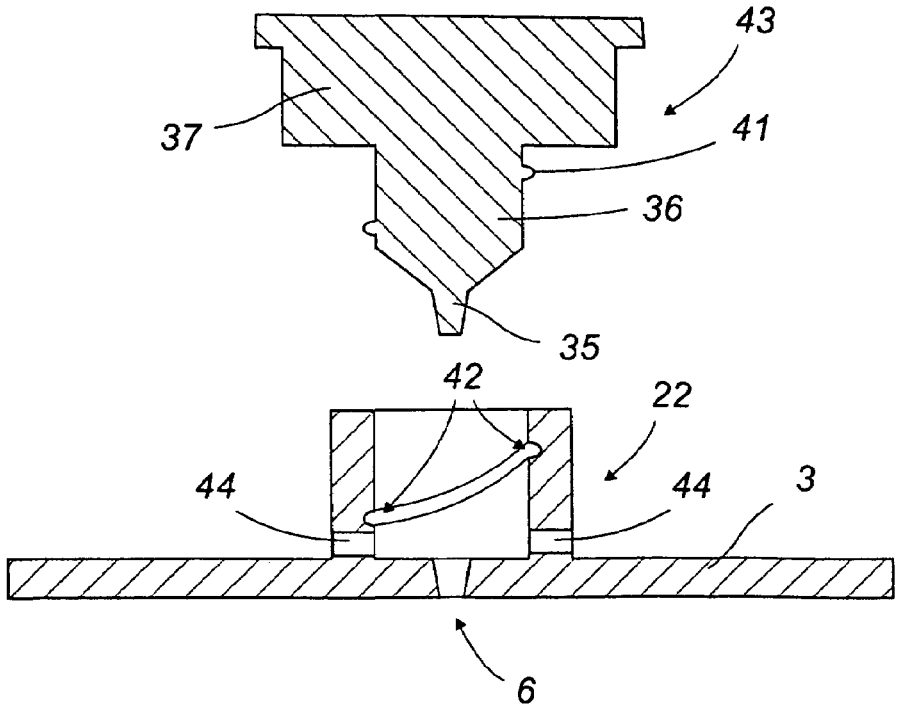

FIG. 10 shows a further embodiment of the plug 43 of the kind with a lower closing pin 35. In this alternative, the air inlet is realized by, at least one or preferably two transverse channels such as 44 placed on the base of the cylindrical reception protrusion 22 of the cup bottom. The switch to the closed low position is also carried out by screwing as previously, i.e. by the male thread 41 on the cylindrical part of the plug body meeting with a female thread 42 in the inner side surface of the cylindrical protrusion or vice versa.

Figure 11:
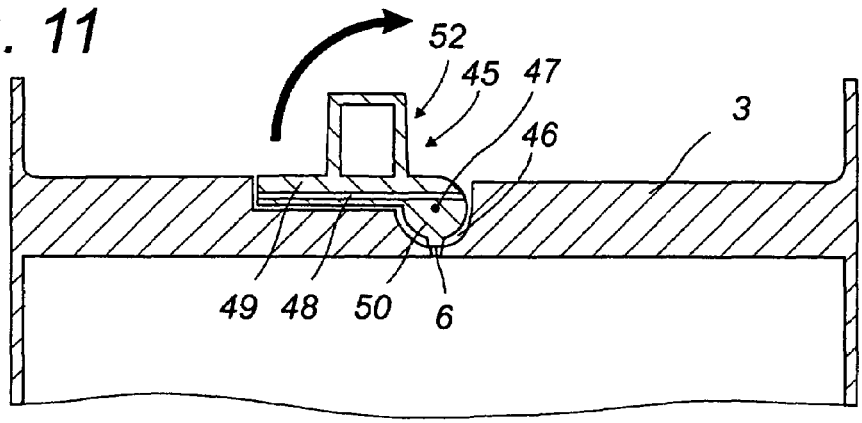
FIGS. 11 and 12 are cross sectional views of a closable vent device of the shutting down type.
Figure 12:
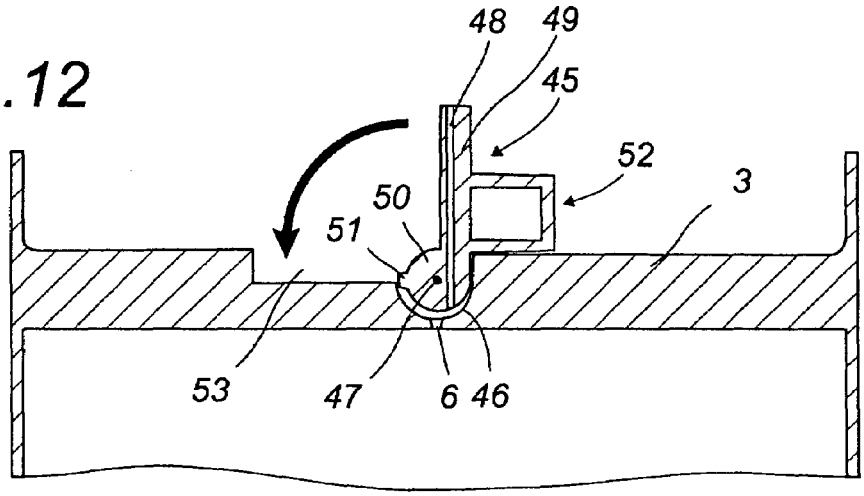
Figure 13:
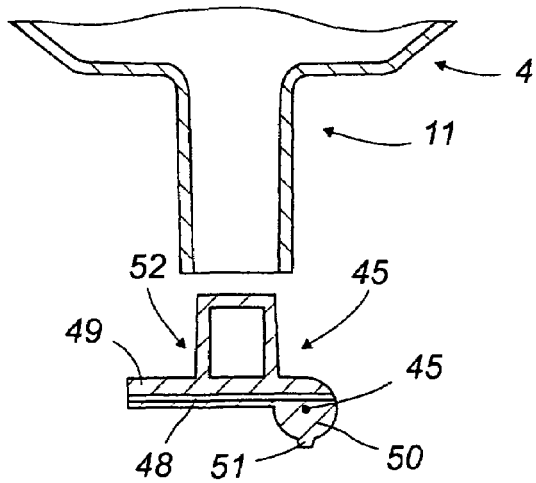
FIG. 13 is a cross sectional view of the outlet end of the cup showing the use of a removable vent part identical to that one shown in FIGS. 11 and 12 as blanking plug of the outlet end of the cup.

The additional alternative embodiment shown in FIGS. 11 to 13 is of the pivoting body type between a closed position in which it is tilted and hidden in the thickness of the bottom wall of the cup and an opening position in which it is upright.

The body of the pivoting movable element 45 of this additional alternative embodiment has the general shape of a whistle set up pivoting in a cavity 46 formed in the bottom wall 3 of the cup by two transverse lugs such as 47 lodged for example by clamping in corresponding opposed slots. This body is longitudinally crossed by an air passage channel 48 which comes out in open position facing or close to the opening 6 of cavity base 46 which is the vent opening in bottom wall 3 of the cup as shown in the drawings. The body of the tilting movable element 45 is made up of a linear elongated part 49 and of a bulb-shaped part 50. In the lower bulb-shape part 50 is conformed a stopping and closing pin 51 intended for closing the opening 6 in the bottom wall 3 of the cup in closed tilted down position and for holding the pivoting movable element 45 in this position. The protrusion corresponding to the pin 51 will ensure that the end of this latter will not protrude out of the inner face of the bottom but will at best flush with this one. The pivoting movable element 45 of this closable vent device has a block 52 in transversal protrusion acting as a means of gripping, as a pivot stop in opened position as shown in FIG. 12 and as a closing plug for the cup outlet should paint preservation be required as shown in FIG. 13.

The pin has an end form ensuring both reduced resistance in operation and sufficient tightness.

In order to house the linear part 49, in tilted down position corresponding to the closed position, a corresponding cavity 53 recessed in the thickness of the bottom wall 3 is for example provided. Bottom wall 3 must, obviously, be thicker for this purpose.

The height of the gripping block 52 will remain under a value, which would make it exceed the surface defined by the upper ridge of the annular edge 5 to ensure the stability of the cup in paint preparation position.

For the body of the cup, the use of certain materials including translucent or opaque materials may be considered for filtering the ultraviolet rays or preserving from them. This consideration proves to be important in the case of photosensitive products.

The invention claimed is:

1. A disposable cup for a spray gun for at least one of preparing, applying and preserving paint, the disposable cup having one of a cylindrical shape or a truncated cone-shaped cup body (1) including a bottom wall (3) with a face having a vent opening (6) formed therein and a cover (4), for closing an open end of the disposable cup, having an outlet duct (11) for dispensing the paint, the outlet duct (11) being directly engagable with one of the spray gun or via an adaptation part (18) of the spray gun (17), the disposable cup having on the bottom wall (3), a vent device (7) including a manually adjusted movable element (20) with a protruding end for cooperating and shutting the vent opening (6) in a closed position of the movable elment (20), and, when the movable element (20) is in the opened position, the movable element (20) frees the protruding end from the vent opening (6) and allows air to enter and occupy an inner volume space created by consumed paint during painting, and when the movable element (20) closes in a liquid-tight way, the vent opening (6), an invertable container is formed which assists with paint preparation, wherein the vent opening (6) is formed in a recessed portion of the bottom wall (3) of the disposable cup and the movable element (20) of the vent device is slidably located within a tubular valve body which forms a valve duct (22), and the movable element (20) prevents air from flowing through valve duct (22) when the movable element (20) is in the closed position.

2. The disposable cup according to claim 1, wherein the closable vent device (7)is located in or on a recessed portion of the bottom wall (3) and the vent device (7), when in the closed position, facilitates filling of the disposable cup with paint to be dispensed.

3. The disposable cup according to claim 1, wherein the movable element (20) has a closing pin which extends, in the closed position, into the vent opening (6) and prevents paint from passing through the vent opening (6).

4. The disposable cup according to claim 1, wherein the valve duct (22) extends from the bottom wall (3) of the disposable cup outward and has, on an inner side face, at least one immobilization structure provided for cooperation with a desired one of two complementary immobilization structures formed in or on a body of the movable element (20) or vice versa.

5. The disposable cup according to claim 1, wherein the valve duct (22) extends from the bottom wall (3) of the disposable cup outward and has, on the inner side face, an inner annular rib (24) for engagement with a desired one of with two complementary annular grooves formed in the body of the movable element (20).

6. The disposable cup according to claim 1, wherein the movable element is one of a solid and a hollow valve plug (25) having a general cylindrical shape, with an upper peripheral edge (26) which forms a shoulder, and a frontal surface of a lower end has a central protrusion and a side surface has immobilization structures for holding the movable element in the two positions and at least one passage of air.

7. The disposable cup according to claim 6, wherein the side surface has two immobilization structures which comprise spaced apart annular elements.

8. The disposable cup according to claim 7, wherein the immobilization structures comprise first and second annular grooves (29, 30) which are successively formed in a side surface of the plug (25) from a bottom to a top of the plug (25) from selectively engaging with an inner annular rib (24), formed in the tubular valve body, and the first annular groove (29) forms an opening stop and the second annular groove (30) forms a closing stop.

9. The disposable cup according to claim 8, wherein the at least one air passage is at least one notch (31, 32) which extends lengthwise along a side surface of the body of the valve plug (25), deeper than the first groove and the at least one air passage extends from a frontal lower end (27), across the first annular groove (29) and terminates before the second annular groove (30).

10. The disposable cup according to claim 6, wherein the central protrusion in the frontal surface of the lower end is a closing pin (28) which has a truncated cone shape for securely closing the vent opening (6), and the plug (25) is held in the closed position by at least one of the immobilization structures.

11. The disposable cup according to claim 10, wherein a size of the closing pin (28) and a penetration of the closing pin (28) into the vent opening (6) are such that the closing pin (28) generallv does not protrude past an inner face of the bottom wall of the disposable cup or, at most is flush with the inner face of the bottom wall (3).

12. The disposable cup according to claim 1, wherein the bottom wall (3) of the disposable cup is set back from a corresponding face of the disposable cup by an annular peripheral edge (5) such that the vent device (7) is recessed from a plane defined by the peripheral edge (5) making up the support edge of the disposable cup in a standing position to provide stability for the disposable cup when filling the disposable cup with paint.

13. The disposable cup according to claim 1, wherein the vent device (7) comprises a cap plug which covers and is slidably mounted at least partially within the tubular valve body.

14. The disposable cup according to claim 13, wherein a cylindrical protrusion in the bottom face of the disposable cup receiving the plug has at least one air passage in a base thereof.

15. The disposable cup according to claim 1, wherein the vent device comprises a plug which is has an internal air passage formed therein.

16. The disposable cup according to claim 15, wherein the internal air passage is divided into two channels in a lower end of the plug.

17. The disposable cup according to claim 1, wherein the vent device comprises a pivoting piece (45) which has an internal air passage channel and the pivoting piece (45) is movable between a closing tilted position in which the vent opening (6) is closed by a protrusion (51) of the pivoting piece (45) and the air passage channel is not aligned with the vent opening (6), and an open position in which an inward end side of the air passage channel communicates with the vent opening (6) in the bottom wall (3) of the disposable cup.

18. The disposable cup according to claim 1, wherein the cup body of the disposable cup is manufactured from a material which is one of opaque, translucent or ultraviolet filtering.

19. A disposable cup for a spray gun for at least one of preparing, applying and preserving paint, the disposable cup having one of a cylindrical shape or a truncated cone-shaped cup body (1) including a bottom wall (3) with a surface having a vent opening (6) formed therein and a cover (4) for covering an open end of the disposable cup, the cover (4) having an outlet duct (11), for dispensing the paint, which is directly engagable with one of the spray gun or via an adaptation part (18) of the spray gun (17), the disposable cup having a manually adjustable movable element (20) with a protruding end for shutting the vent opening (6) when the movable element (20) is in a closed position, and, when the movable element (20)is in an opened position, the movable element(20) facilitating entry of air through the vent opening (6) to replace, during painting, an inner volume space created by consumed paint, and when the movable element is in the closed position, the movable element (20) closes the vent opening (6), in a liquid-tight manner, so as to form a container which assists with paint preparation;

wherein the vent opening (6) is formed in a recessed portion of the bottom wall (3)of the disposable cup which is sufficiently recessed and spaced from a plane defined by an annular peripheral edge (5) of the disposable cup such that when the disposable cup is inverted and supported by the annular peripheral edge (5), the disposable cup is able to stand in the inverted position in a stable manner with the movable element (20) spaced from the plane, and the movable element (20) of the vent device is slidably located within a tubular valve body which defines a valve duct (22), and the movable element (20) prevents air from flowing through the valve duct (22) when the movable element (20) is in the closed position; and a second valve plug (33) is engageable with the outlet duct (11) of the cover for forming a sealed container to store paint.

20. A disposable cup for a spray gun which assists with at least one of preparing, applying and preserving a paint, the disposable cup having one of a cylindrical shape or a truncated cone-shaped body (1) and including a bottom wall (3) with an annular peripheral edge (5), the bottom wall (3) having a closable vent device (7) with a manually adjustable movable element for closing a vent opening (6) of the vent device (7), and a cover (4) for sealing an opening of the disposable cup, the cover (4) having an outlet duct (11) which is connectable to one of the spray gun and an adaptation part (18) for the spray gun (17), wherein the manually adjustable movable element, when in a closed position, sealingly engages and closes the vent opening (6), the vent device (7) comprises a tubular valve body which extends from the bottom wall (3) of the disposable cup and an interior of the tubular valve body communicates, via the vent opening (6), with an interior space of the disposable cup to facilitate passage of air to the interior space of the disposable cup and replacing consumed paint during use, the manually adjustable movable element (20), with a protruding end, is manually movable within and along the tubular valve body to the closed position and to an opened position, the protruding end of the movable element (20) which faces the bottom wall (3) is adapted for sealingly engaging and closing the vent opening (6) in a liquid-tight manner when the movable element (20) is in the closed position, the tubular valve body defines a valve duct (22) which facilitates air enter into the tubular valve body when the movable element (20) is at least in the opened position, the movable element (20) always remains accommodated within the tubular valve body, even when the movable element (20) is in the opened position, and, when the vent opening (6) is closed by the movable element (20), and the movable element (20) seals the vent opening (6) and results in a container which assists with paint preparation.

21. The disposable cup according to claim 20, wherein a portion of the bottom wall (3) of the disposable cup, accommodating the closable vent device (7), is sufficiently recessed and spaced from a plane defined by an annular peripheral edge (5) of the bottom wall (3) such that when the disposable cup is inverted and supported on a surface solely by the annular peripheral edge (5), the disposable cup is able to stand in a stable manner in the inverted position unaffected by the vent device (7), and a valve plug (33) is provided for sealing the outlet duct (11) of the cover (4) and forming a sealed paint container for storing paint.

* * * * *